US010522084B2

(12) United States Patent
Zhang et al.

(10) Patent No.: US 10,522,084 B2
(45) Date of Patent: Dec. 31, 2019

(54) ADAPTIVE PIXEL VOLTAGE COMPENSATION FOR DISPLAY PANELS

(71) Applicant: Apple Inc., Cupertino, CA (US)

(72) Inventors: Sheng Zhang, Milpitas, CA (US); Chaohao Wang, Sunnyvale, CA (US); Paolo Sacchetto, Cupertino, CA (US); Paul S. Drzaic, Morgan Hill, CA (US); Wei Chen, Palo Alto, CA (US); Wei H. Yao, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 111 days.

(21) Appl. No.: 15/711,585

(22) Filed: Sep. 21, 2017

(65) Prior Publication Data

US 2018/0322827 A1 Nov. 8, 2018

Related U.S. Application Data

(60) Provisional application No. 62/501,499, filed on May 4, 2017.

(51) Int. Cl.

| | |
|---|---|
| ***G09G 3/3241*** | (2016.01) |
| ***G09G 3/3233*** | (2016.01) |
| ***G09G 3/20*** | (2006.01) |

(52) U.S. Cl.

CPC ..... *G09G 3/3241* (2013.01); *G09G 3/2011* (2013.01); *G09G 3/3233* (2013.01); *G09G 2310/027* (2013.01); *G09G 2310/0272* (2013.01); *G09G 2310/0289* (2013.01); *G09G 2320/0233* (2013.01); *G09G 2320/0242* (2013.01); *G09G 2320/041* (2013.01); *G09G 2354/00* (2013.01)

(58) Field of Classification Search

CPC .. G09G 3/3241; G09G 3/3233; G09G 3/2011; G09G 2320/0242; G09G 2320/0233; G09G 2320/041; G09G 2310/0272; G09G 2310/027; G09G 2310/0289; G09G 2354/00

See application file for complete search history.

(56) References Cited

U.S. PATENT DOCUMENTS 7,321,348 B2 * 1/2008 Cok ..... G09G 3/3225 345/208

2012/0139955 A1 * 6/2012 Jaffari ..... G06F 17/5018 345/690

(Continued)

*Primary Examiner* — Brent D Castiaux

(74) *Attorney, Agent, or Firm* — Fletcher Yoder, P.C.

(57) ABSTRACT

A display device may include a display having a plurality of pixels. The display device may also include a replica pixel circuit having a switching device configured to output a first current based on a received voltage, a light-emitting diode (LED) configured to illuminate to a first gray level based on the first current output by the switching device, and current mirror circuitry configured to generate a second current that mirrors the first current. In addition, the replica pixel circuit may include a current source configured to output a reference current based on a voltage value that corresponds to the received voltage, comparator circuitry configured to determine a difference between the second current and the reference current, and voltage adjustment circuitry configured to adjust a source voltage output provided to the plurality of pixels based on the difference.

14 Claims, 12 Drawing Sheets

(56) References Cited

U.S. PATENT DOCUMENTS

| | | | | |
|---|---|---|---|---|
| 2015/0009204 | A1* | 1/2015 | Chaji | G09G 3/3233 345/214 |
| 2015/0042694 | A1* | 2/2015 | Lee | G09G 3/3225 345/690 |
| 2015/0042703 | A1* | 2/2015 | Chaji | G09G 3/3233 345/694 |
| 2016/0086548 | A1 | 3/2016 | Maeyama | |

* cited by examiner

TOP EMISSION

ADAPTIVE PIXEL VOLTAGE COMPENSATION FOR DISPLAY PANELS

CROSS-REFERENCE TO RELATED APPLICATION

This application claims priority to and benefit from U.S. Provisional Application No. 62/501,499, filed May 4, 2017, entitled "Adaptive Pixel Voltage Compensation for Display Panels," the contents of which is incorporated by reference in its entirety.

BACKGROUND

The present disclosure relates to systems and methods for sensing characteristics of pixels in electronic display devices to compensate for variance in luminance or color properties of pixels in the electronic display device.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As electronic displays are employed in a variety of electronic devices, such as mobile phones, televisions, tablet computing devices, and the like, manufacturers of the electronic displays continuously seek ways to improve the consistency of colors depicted on the electronic display devices. For example, given various ambient conditions in which each display device operates, pixels within a display device might emit a different color values or gray levels due to the different ambient conditions. It is desirable, however, for the pixels in various ambient environments to depict the intended color or gray level with respect to the provided pixel data to preserve the integrity and quality of the image depicted via the electronic display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain electronic display devices, light-emitting diodes such as organic light-emitting diodes (OLEDs), micro-LEDs (μLEDs), or micro display-based OLEDs may be employed as pixels to depict a range of gray levels for display. However, due to various properties associated with ambient conditions (e.g., temperature) surrounding a display panel, display properties (e.g., display usage, aging) of the display panel or pixels within the display panel, an expected gray level output by one or more pixels in a display device may be different from an actual gray level output by the pixels in the display device upon receiving a certain electrical input. For example, as the ambient temperature in which a display panel operates changes, a bias voltage associated with the components within a pixel driving circuit may also change. As such, the current provided to illuminate a pixel may change due to the change in the bias voltage. As a result, the pixel may illuminate differently than expected. In other words, the pixel may not output a desired gray level, as provided in the corresponding image data.

To ensure that the pixels of a display device accurately depict the desired gray levels in accordance with the provided image data, a replica pixel circuit, similar to that used by each pixel in the display device, may be disposed within the display device. The replica pixel circuit may include similar components as provided in the pixel circuit, such as a light-emitting diode (LED) and a switch. As discussed above, components (e.g., light-emitting diode) within the replica pixel circuit may include a bias voltage that changes in different ambient conditions. As such, the replica circuit may use a comparator component to compare a driving current that is provided to the LED with a reference current that corresponds to an expected current for the pixel based on a provided input voltage for the pixel. The comparator component may determine a difference between the driving current and the reference current. The difference between these two currents may correspond to the change in the bias voltage of the circuit component based on the ambient conditions. Based on the change in the bias voltage, the replica pixel circuit may adjust a voltage of a source voltage (e.g., $V_{SS}$) that provides a voltage to various components (e.g., light-emitting diode) within the replica pixel circuit. By adjusting the voltage of the source voltage ($V_{SS}$), the replica pixel circuit may adjust the driving current received by the LED, such that it more closely matches the reference current. In certain embodiments, the adjusted source voltage ($V_{SS}$) may be coupled to pixel circuits that are used to drive each pixel in the display device. In this way, the replica pixel circuit may compensate for bias voltage effects present in the pixel driving circuits of the display that may be caused by ambient conditions or the like.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
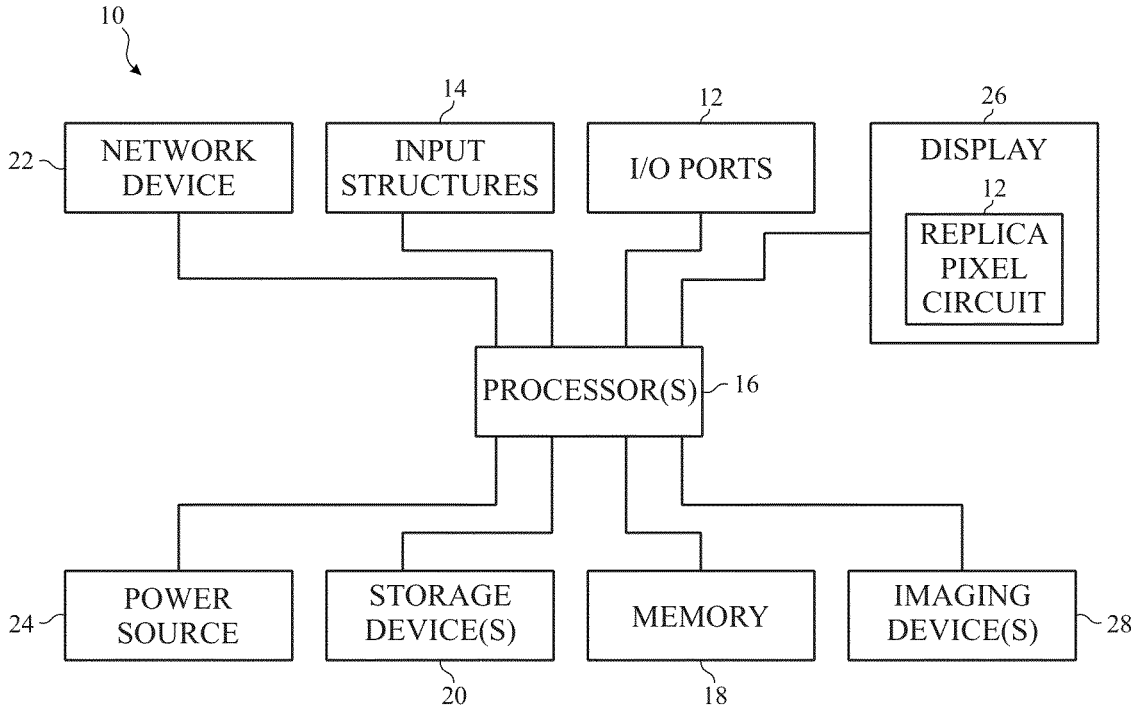
FIG. 1 is a simplified block diagram of components of an electronic device that may depict image data on a display, in accordance with embodiments described herein.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Organic light-emitting diode (e.g., OLED, AMOLED) display panels provide opportunities to make thin, flexible, high-contrast, and color-rich electronic displays. Generally, OLED display devices are current driven devices and use thin film transistors (TFTs) as current sources to provide certain amount of current to generate a certain level of luminance to a respective pixel electrode. As mentioned above, a bias voltage associated with a circuit component within a pixel driving circuit may change based on various ambient conditions (e.g., temperature). As the bias voltage of the circuit component changes, the current output by the circuit component to illuminate the respective pixel electrode to a particular gray level may also change. As such, to compensate for the bias voltage changes due to ambient conditions, a replica pixel circuit may be disposed within a display device to monitor the performance or output properties (e.g., gray level) of a pixel within the replica pixel circuit. That is, in some embodiments, the replica pixel circuit may receive an input voltage that corresponds to a particular gray level to be depicted by the respective pixel electrode. After receiving the input voltage, the replica pixel circuit may provide a drive current to the respective pixel electrode or light-emitting diode (LED). In addition to providing the drive current to the respective pixel electrode, the replica pixel circuit may also include a current mirror circuit that provides a mirror drive current that matches the drive current to a comparator component. The comparator component may also receive a reference current that corresponds to an expected drive current that the respective pixel electrode is expected to receive given the input voltage. The comparator component may compare the mirror current to the reference current. If the mirror current and the reference current do not match, the replica pixel circuit may adjust a source voltage output that is coupled to the replica pixel circuit to cause the actual drive current to more closely match the reference current. In certain embodiments, the source voltage output may be coupled to each pixel driving circuit of the display device, such that as the replica pixel circuit identifies the appropriate source voltage output value to cause the mirror current to substantially match the reference current in the replica circuit, the pixel driving circuits of the display device are also provided with the same source voltage output. By adjusting the source voltage output to the pixel driving circuits of the display device, the driving currents provided to the respective pixels of the display device may accurately reflect the current that is expected to be received by the pixels based on the provided input voltage in light of the given ambient conditions. Additional details with regard to adaptively adjusting a source voltage for a pixel circuit to compensate for bias voltage effects of the pixel driving circuits will be discussed below with reference to FIGS. 1-16.

By way of introduction, FIG. 1 is a block diagram illustrating an example of an electronic device 10 that may include the sensing system mentioned above. The electronic device 10 may be any suitable electronic device, such as a laptop or desktop computer, a mobile phone, a digital media player, television, or the like. By way of example, the electronic device 10 may be a portable electronic device, such as a model of an iPod® or iPhone®, available from Apple Inc. of Cupertino, Calif. The electronic device 10 may be a desktop or notebook computer, such as a model of a MacBook®, MacBook® Pro, MacBook Air®, iMac®, Mac® Mini, or Mac Pro®, available from Apple Inc. In other embodiments, electronic device 10 may be a model of an electronic device from another manufacturer.

As shown in FIG. 1, the electronic device 10 may include various components. The functional blocks shown in FIG. 1 may represent hardware elements (including circuitry), software elements (including code stored on a computer-readable medium) or a combination of both hardware and software elements. In the example of FIG. 1, the electronic device 10 includes input/output (I/O) ports 12, input structures 14, one or more processors 16, a memory 18, nonvolatile storage 20, network device 22, power source 24, display 26, and one or more imaging devices 28. It should be appreciated, however, that the components illustrated in FIG. 1 are provided only as an example. Other embodiments of the electronic device 10 may include more or fewer components. To provide one example, some embodiments of the electronic device 10 may not include the imaging device(s) 28.

Before continuing further, it should be noted that the system block diagram of the device 10 shown in FIG. 1 is intended to be a high-level control diagram depicting various components that may be included in such a device 10. That is, the connection lines between each individual component shown in FIG. 1 may not necessarily represent paths or directions through which data flows or is transmitted between various components of the device 10. Indeed, as discussed below, the depicted processor(s) 16 may, in some embodiments, include multiple processors, such as a main processor (e.g., CPU), and dedicated image and/or video processors. In such embodiments, the processing of image data may be primarily handled by these dedicated processors, thus effectively offloading such tasks from a main processor (CPU).

Considering each of the components of FIG. 1, the I/O ports 12 may represent ports to connect to a variety of devices, such as a power source, an audio output device, or other electronic devices. The input structures 14 may enable user input to the electronic device, and may include hardware keys, a touch-sensitive element of the display 26, and/or a microphone.

The processor(s) 16 may control the general operation of the device 10. For instance, the processor(s) 16 may execute an operating system, programs, user and application interfaces, and other functions of the electronic device 10. The processor(s) 16 may include one or more microprocessors and/or application-specific microprocessors (ASICs), or a combination of such processing components. For example, the processor(s) 16 may include one or more instruction set (e.g., RISC) processors, as well as graphics processors (GPU), video processors, audio processors and/or related chip sets. As may be appreciated, the processor(s) 16 may be coupled to one or more data buses for transferring data and instructions between various components of the device 10. In certain embodiments, the processor(s) 16 may provide the processing capability to execute an imaging applications on the electronic device 10, such as Photo Booth®, Aperture®, iPhoto®, Preview®, iMovie®, or Final Cut Pro® available from Apple Inc., or the "Camera" and/or "Photo" applications provided by Apple Inc. and available on some models of the iPhone®, iPod®, and iPad®.

A computer-readable medium, such as the memory 18 or the nonvolatile storage 20, may store the instructions or data to be processed by the processor(s) 16. The memory 18 may include any suitable memory device, such as random access memory (RAM) or read only memory (ROM). The nonvolatile storage 20 may include flash memory, a hard drive, or any other optical, magnetic, and/or solid-state storage media. The memory 18 and/or the nonvolatile storage 20 may store firmware, data files, image data, software programs and applications, and so forth.

The network device 22 may be a network controller or a network interface card (NIC), and may enable network communication over a local area network (LAN) (e.g., Wi-Fi), a personal area network (e.g., Bluetooth), and/or a wide area network (WAN) (e.g., a 3G or 4G data network). The power source 24 of the device 10 may include a Li-ion battery and/or a power supply unit (PSU) to draw power from an electrical outlet or an alternating-current (AC) power supply.

The display 26 may display various images generated by device 10, such as a GUI for an operating system or image data (including still images and video data). The display 26 may be any suitable type of display, such as a liquid crystal display (LCD), plasma display, or an organic light emitting diode (OLED) display, for example. In one embodiment, the display 26 may include self-emissive pixels such as organic light emitting diodes (OLEDs) or micro-light-emitting-diodes (μ-LEDs).

Additionally, as mentioned above, the display 26 may include a touch-sensitive element that may represent an input structure 14 of the electronic device 10. The imaging device(s) 28 of the electronic device 10 may represent a digital camera that may acquire both still images and video. Each imaging device 28 may include a lens and an image sensor capture and convert light into electrical signals.

In certain embodiments, the display 26 may include a replica pixel circuit 30, which may include similar circuit components as provided for each pixel within the display 26. The replica pixel circuit 30 may determine whether ambient conditions surrounding the display 26 are affecting the driving properties of the pixels within the display 26. Moreover, the replica pixel circuit 30 may adjust a source voltage output (e.g., $V_{SS}$) that may be coupled to each pixel driving circuit of the display 26 to compensate for the effects of the ambient conditions. Additional details with regard to the replica pixel circuit 30 will be discussed below with reference to FIG. 9.

Figure 2:
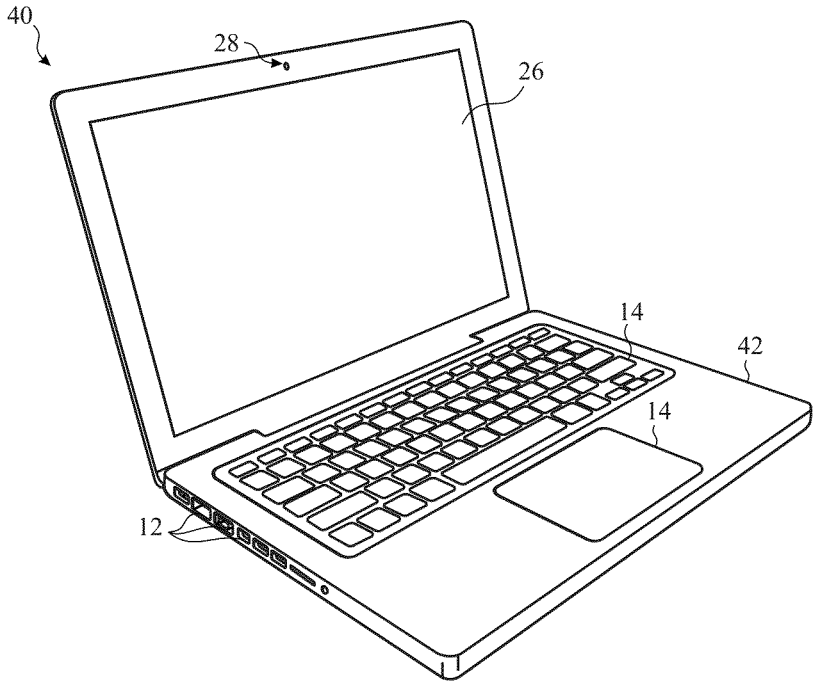
FIG. 2 is a perspective view of the electronic device of FIG. 1 in the form of a notebook computing device, in accordance with embodiments described herein.

As mentioned above, the electronic device 10 may take any number of suitable forms. Some examples of these possible forms appear in FIGS. 2-6. Turning to FIG. 2, a notebook computer 40 may include a housing 42, the display 26, the I/O ports 12, and the input structures 14. The input structures 14 may include a keyboard and a touchpad mouse that are integrated with the housing 42. Additionally, the input structure 14 may include various other buttons and/or switches which may be used to interact with the computer 40, such as to power on or start the computer, to operate a GUI or an application running on the computer 40, as well as adjust various other aspects relating to operation of the computer 40 (e.g., sound volume, display brightness, etc.). The computer 40 may also include various I/O ports 12 that provide for connectivity to additional devices, as discussed above, such as a FireWire® or USB port, a high definition multimedia interface (HDMI) port, or any other type of port that is suitable for connecting to an external device. Additionally, the computer 40 may include network connectivity (e.g., network device 22), memory (e.g., memory 18), and storage capabilities (e.g., storage device 20), as described above with respect to FIG. 1.

The notebook computer 40 may include an integrated imaging device 28 (e.g., a camera). In other embodiments, the notebook computer 40 may use an external camera (e.g., an external USB camera or a "webcam") connected to one or more of the I/O ports 12 instead of or in addition to the integrated imaging device 28. In certain embodiments, the depicted notebook computer 40 may be a model of a MacBook®, MacBook® Pro, MacBook Air®, or PowerBook® available from Apple Inc. In other embodiments, the computer 40 may be portable tablet computing device, such as a model of an iPad® from Apple Inc.

Figure 3:
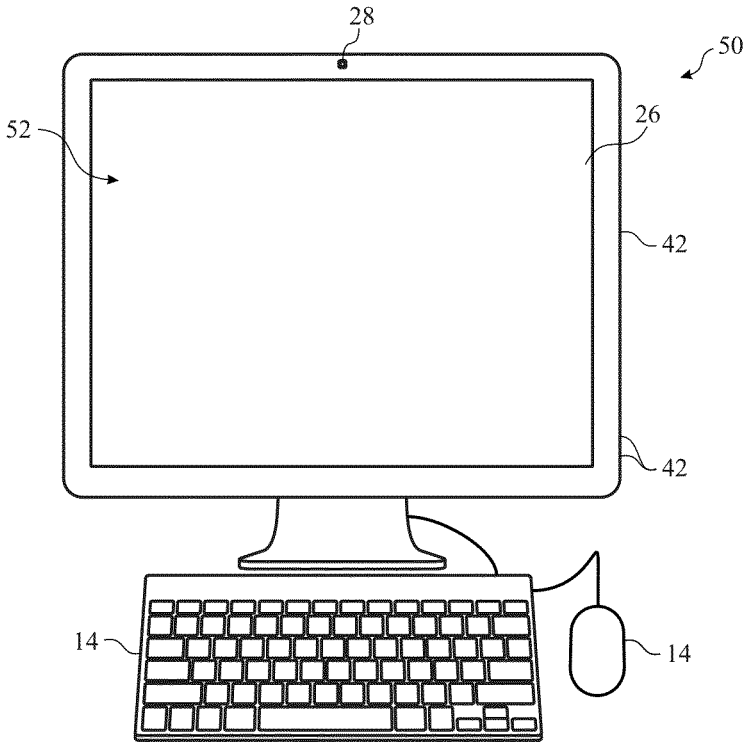
FIG. 3 is a front view of the electronic device of FIG. 1 in the form of a desktop computing device, in accordance with embodiments described herein.

FIG. 3 shows the electronic device 10 in the form of a desktop computer 50. The desktop computer 50 may include a number of features that may be generally similar to those provided by the notebook computer 40 shown in FIG. 4, but may have a generally larger overall form factor. As shown, the desktop computer 50 may be housed in an enclosure 42 that includes the display 26, as well as various other components discussed above with regard to the block diagram shown in FIG. 1. Further, the desktop computer 50 may include an external keyboard and mouse (input structures 14) that may be coupled to the computer 50 via one or more I/O ports 12 (e.g., USB) or may communicate with the computer 50 wirelessly (e.g., RF, Bluetooth, etc.). The desktop computer 50 also includes an imaging device 28, which may be an integrated or external camera, as discussed above. In certain embodiments, the depicted desktop computer 50 may be a model of an iMac®, Mac® mini, or Mac Pro®, available from Apple Inc.

Figure 4:
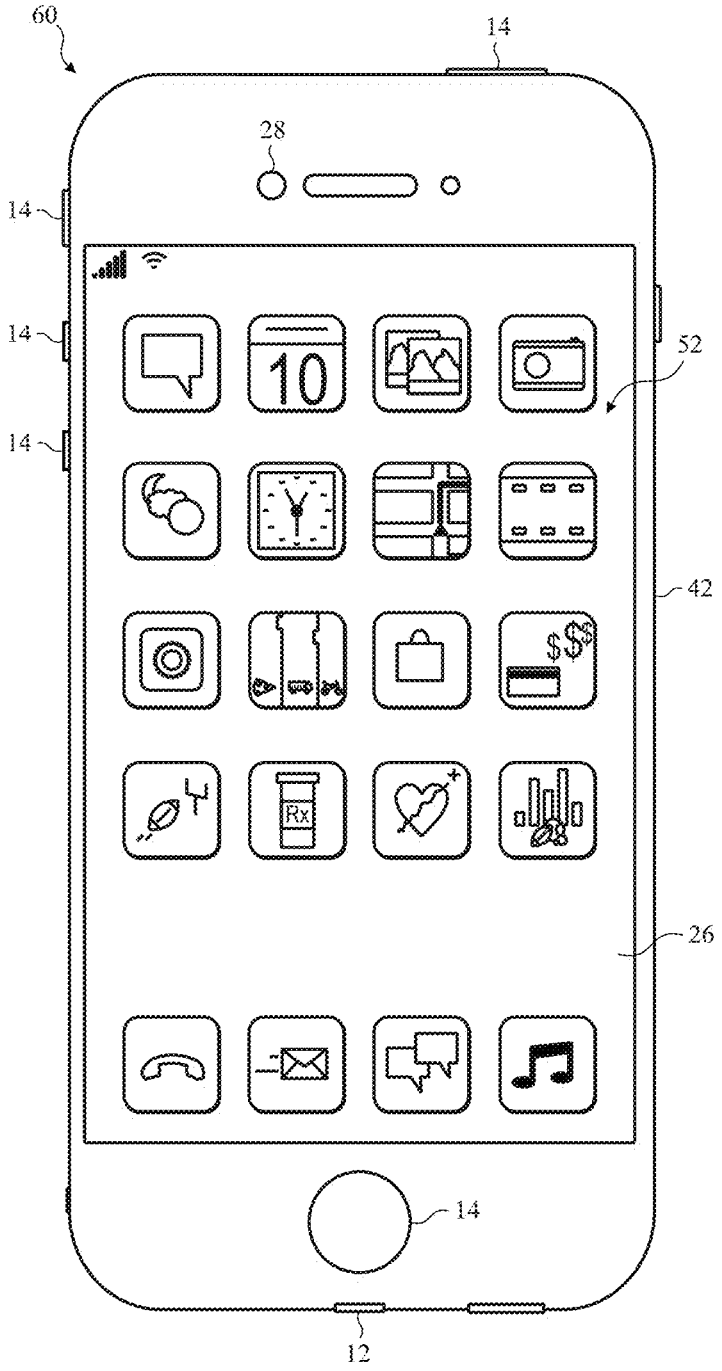
FIG. 4 is a front view of the electronic device of FIG. 1 in the form of a handheld portable electronic device, in accordance with embodiments described herein.
Figure 5:
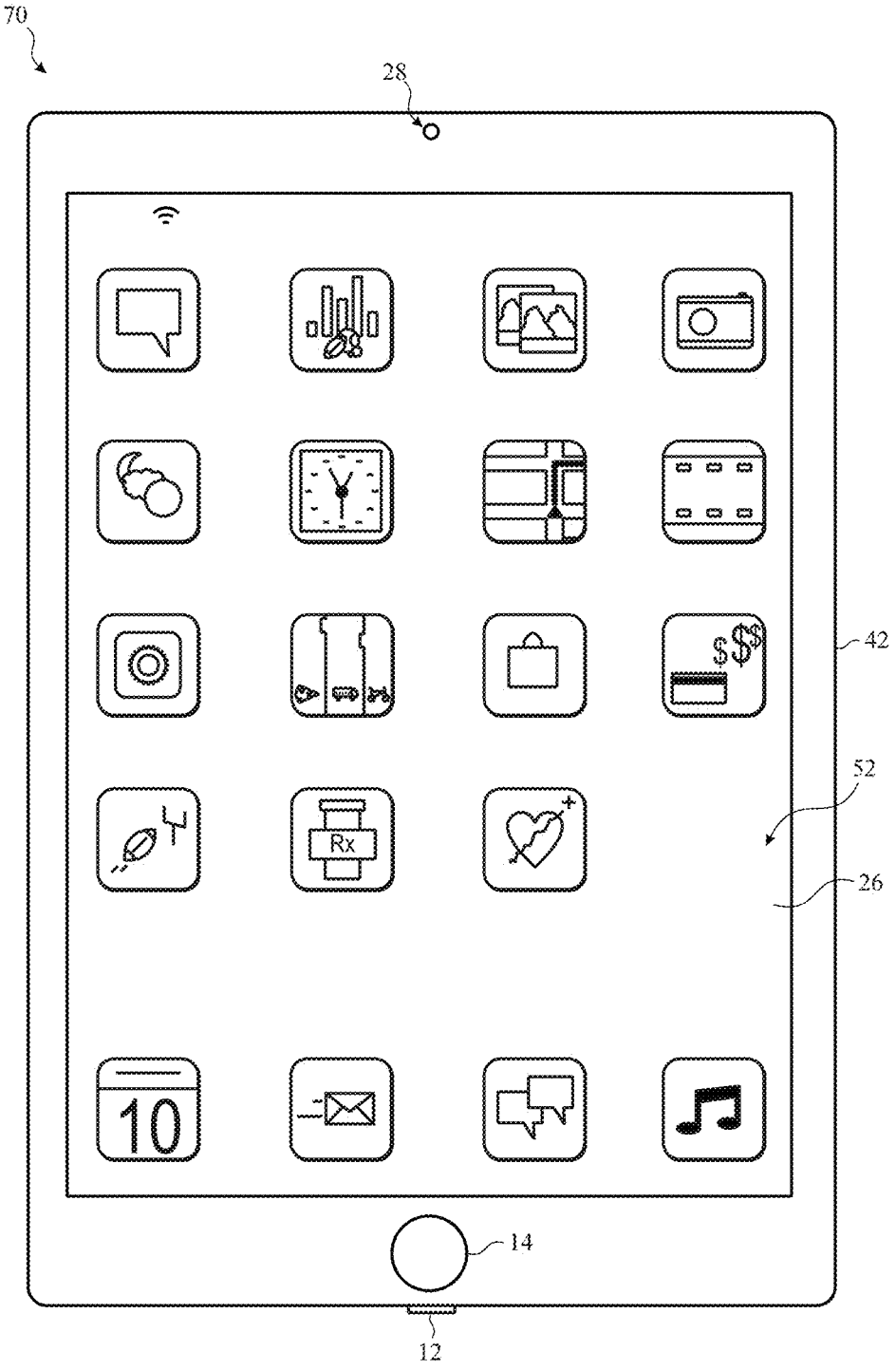
FIG. 5 is a front view of the electronic device of FIG. 1 in the form of a tablet computing device, in accordance with embodiments described herein.

The electronic device 10 may also take the form of portable handheld device 60 or 70, as shown in FIGS. 4 and 5. By way of example, the handheld device 60 or 70 may be a model of an iPod® or iPhone® available from Apple Inc. The handheld device 60 or 70 includes an enclosure 42, which may function to protect the interior components from physical damage and to shield them from electromagnetic interference. The enclosure 42 also includes various user input structures 14 through which a user may interface with the handheld device 60 or 70. Each input structure 14 may control various device functions when pressed or actuated. As shown in FIGS. 4 and 5, the handheld device 60 or 70 may also include various I/O ports 12. For instance, the depicted I/O ports 12 may include a proprietary connection port for transmitting and receiving data files or for charging a power source 24. Further, the I/O ports 12 may also be used to output voltage, current, and power to other connected devices.

The display 26 may display images generated by the handheld device 60 or 70. For example, the display 26 may display system indicators that may indicate device power status, signal strength, external device connections, and so forth. The display 26 may also display a GUI 52 that allows a user to interact with the device 60 or 70, as discussed above with reference to FIG. 3. The GUI 52 may include graphical elements, such as the icons, which may correspond to various applications that may be opened or executed upon detecting a user selection of a respective icon.

Figure 6:
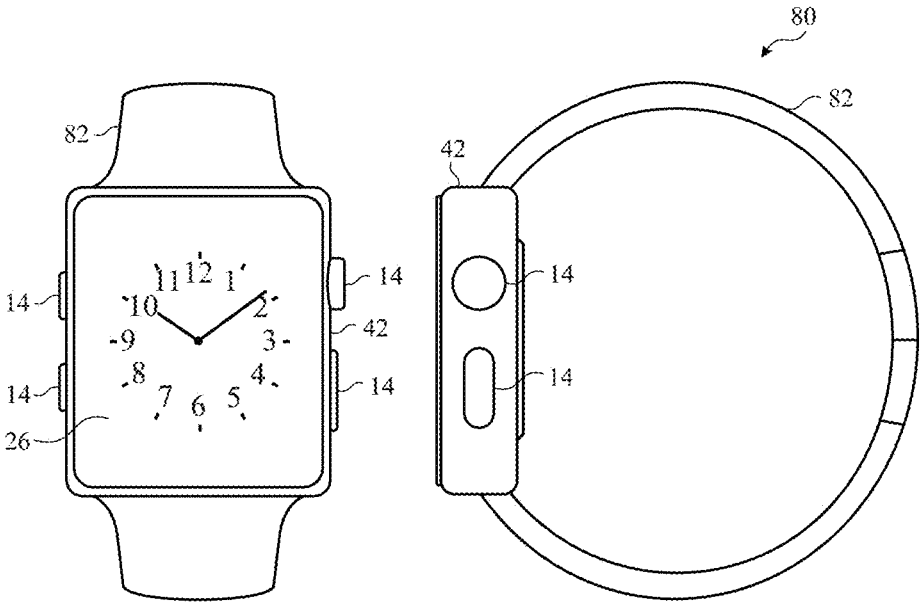
FIG. 6 is a front view and side view of a wearable electronic device representing another embodiment of the electronic device of FIG. 1.

Similarly, FIG. 6 depicts a wearable electronic device 80 representing another embodiment of the electronic device 10 of FIG. 1 that may be configured to operate using the techniques described herein. By way of example, the wearable electronic device 80, which may include a wristband 82, may be an Apple Watch® by Apple, Inc. However, in other embodiments, the wearable electronic device 80 may include any wearable electronic device such as, for example, a wearable exercise monitoring device (e.g., pedometer, accelerometer, heart rate monitor), or other device by another manufacturer. The display 26 of the wearable electronic device 80 may include a touch screen display (e.g., LCD, OLED display, active-matrix organic light emitting diode (AMOLED) display, and so forth), as well as input structures 14, which may allow users to interact with a user interface of the wearable electronic device 80.

Figure 7:
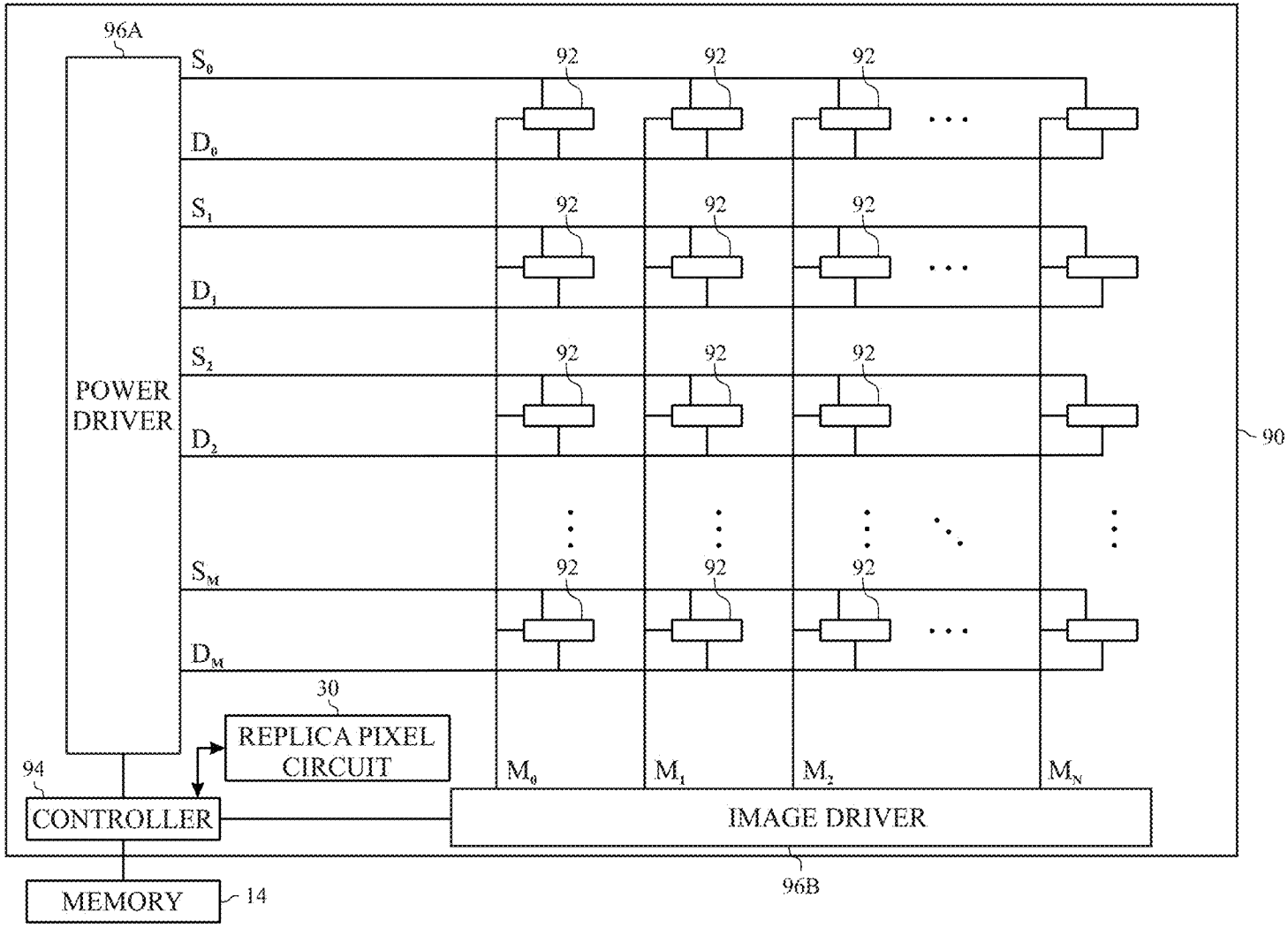
FIG. 7 is a circuit diagram of an array of self-emissive pixels of the electronic display of the electronic device of FIG. 1, in accordance with aspects of the present disclosure.

Having provided some context with regard to possible forms that the electronic device 10 may take, the present discussion will now focus on the replica pixel circuit 30 of FIG. 1. Generally, the brightness depicted by each respective pixel in the display 26 is controlled by varying an electric field associated with each respective pixel in the display 26. Keeping this in mind, FIG. 7 illustrates one embodiment of a circuit diagram of display 26 that may generate the electrical field that energizes each respective pixel and causes each respective pixel to emit light at an intensity corresponding to an applied voltage. As shown, display 26 may include a self-emissive pixel array 90 having an array of self-emissive pixels 92.

The self-emissive pixel array 90 is shown having a controller 94, a power driver 96A, an image driver 96B, and the array of self-emissive pixels 92. The self-emissive pixels 92 are driven by the power driver 96A and image driver 96B. Each power driver 96A and image driver 96B may drive one or more self-emissive pixels 92. In some embodiments, the power driver 96A and the image driver 96B may include multiple channels for independently driving multiple self-emissive pixels 92. The self-emissive pixels 92 may include any suitable light-emitting elements, such as organic light emitting diodes (OLEDs), micro-light-emitting-diodes (μ-LEDs), and the like.

The power driver 96A may be connected to the self-emissive pixels 92 by way of scan lines $S_0$, $S_1$, . . . $S_{m-1}$, and $S_m$ and driving lines $D_0$, $D_1$, . . . $D_{m-1}$, and $D_m$. The self-emissive pixels 92 receive on/off instructions through the scan lines $S_0$, $S_1$, . . . $S_{m-1}$, and $S_m$ and generate driving currents corresponding to data voltages transmitted from the driving lines $D_0$, $D_1$, . . . $D_{m-1}$, and $D_m$. The driving currents are applied to each self-emissive pixel 92 to emit light according to instructions from the image driver 96B through driving lines $M_0$, $M_1$, . . . $M_{n-1}$, and $M_n$. Both the power driver 96A and the image driver 96B transmit voltage signals through respective driving lines to operate each self-emissive pixel 92 at a state determined by the controller 94 to emit light. Each driver may supply voltage signals at a duty cycle and/or amplitude sufficient to operate each self-emissive pixel 92.

The controller 94 may control the color of the self-emissive pixels 92 using image data generated by the processor(s) 16 and stored into the memory 18 or provided directly from the processor(s) 16 to the controller 94. In some embodiments, the replica pixel circuit 30 may provide a signal to the controller 94 to adjust the data signals transmitted to the self-emissive pixels 92, such that the self-emissive pixels 92 may compensate for certain bias voltage effects of pixels in the display 26 due to certain ambient conditions (e.g., temperature).

Figure 8:
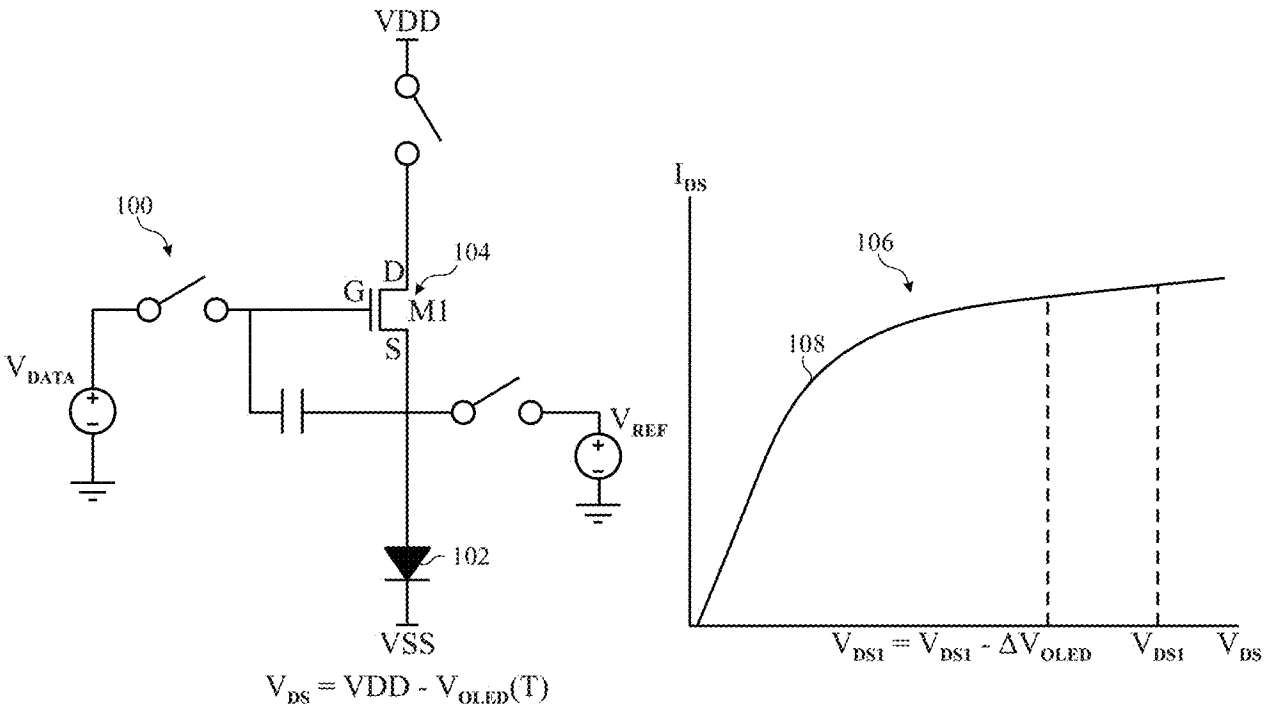
FIG. 8 is a circuit diagram of a pixel driving circuit for a pixel in the display of the electronic device of FIG. 1, in accordance with embodiments described herein.

With the foregoing in mind, FIG. 8 illustrates an example pixel circuit 100 for driving a pixel 92. The pixel circuit 100 may include a light-emitting diode (LED) 102 that may illuminate based on an amount of current provided thereto. The LED 102 may be any suitable LED, as mentioned above, that may be employed for display technologies, such as an organic LED, a micro-LED, and the like.

In addition to the LED 102, the pixel circuit 100 may include a switch 104. The switch 104 may be a driving transistor or any suitable switching circuitry. In one embodiment, the switch 104 may receive a data voltage (e.g., $V_{data}$) that may cause the switch to provide the LED 102 to a certain amount of current (e.g., $I_{ds}$). The current $I_{ds}$ provided to the LED 102 may cause the LED 102 to illuminate to a particular gray level that corresponds to the data voltage $V_{data}$.

With the foregoing in mind, the LED 102 may be coupled to a source voltage ($V_{SS}$) and to a drain voltage ($V_{DD}$) via the switch 104. The source voltage $V_{SS}$ and the drain voltage $V_{DD}$ may be fixed voltage levels provided by the same or different sources. Generally, the drain voltage $V_{DD}$ may have the same value but opposite polarity of the source voltage $V_{SS}$. In any case, as the ambient conditions surrounding the LED 102 changes, an operation point of the switch 104 may also change. For instance, as the ambient temperature surrounding the LED 102 changes a bias voltage ($V_{OLED}$) associated with the LED 102 may also change. For certain pixel structures, such as the pixel circuit 100, the bias voltage change directly changes a gate-to-source voltage ($V_{gs}$) of the switch 104. As a result, the drain-to-source ($V_{ds}$) may change, thereby changing the amount of current $I_{ds}$ that may be provided to the LED 102.

By way of illustration, graph 106 illustrates a sample curve 108 that represents a change in the drain-to-source current $I_{ds}$ with respect to a change in the drain-to-source voltage $V_{ds}$ of the switch 104. As shown in the graph 106, the drain-to-source current $I_{ds}$ decreases when the drain-to-source voltage $V_{ds}$ changes from $V_{ds1}$ to $V_{ds2}$. The resulting decrease drain-to-source current $I_{ds}$ is provided to the LED 102, and the LED 102 illuminates to emit an amount of light (e.g., gray level) that corresponds to the provided current $I_{ds}$. However, since the provided current $I_{ds}$ does not match the expected current $I_{ds}$ associated with the unbiased drain-to-source voltage $V_{ds1}$, the gray level depicted by the LED 102 does not correspond to a desired gray level, as specified by a data voltage $V_{data}$.

To compensate for bias voltage effects that may be experienced by the switch 104 due to various ambient conditions (e.g., temperature) or other properties (e.g., display usage, pixel aging) related to the display 26, in one embodiment, a replica pixel circuit 30 may be included in display 26. The replica pixel circuit 30 may include similar components as the pixel circuits used to drive the pixels 92 of the display 26. As such, the replica pixel circuit 30 may experience the same bias voltage effects that may occur within the pixel circuits of the display 26. Based on the detected bias voltage effects in the replica pixel circuit 30, a controller or control system may adjust the voltage levels of the drain voltage $V_{DD}$, the source voltage $V_{SS}$, or both to compensate for the bias voltage effects. That is, the drain voltage $V_{DD}$ or source voltage $V_{SS}$ may be adjusted to cause the switch 104 of the replica pixel circuit 30 to provide a current $I_{ds}$ that corresponds to an expected current $I_{ds}$ given a reference voltage ($V_{data}$). Additional details regarding the operation of the replica pixel circuit 30 will be discussed below with reference to FIG. 9.

Figure 9:
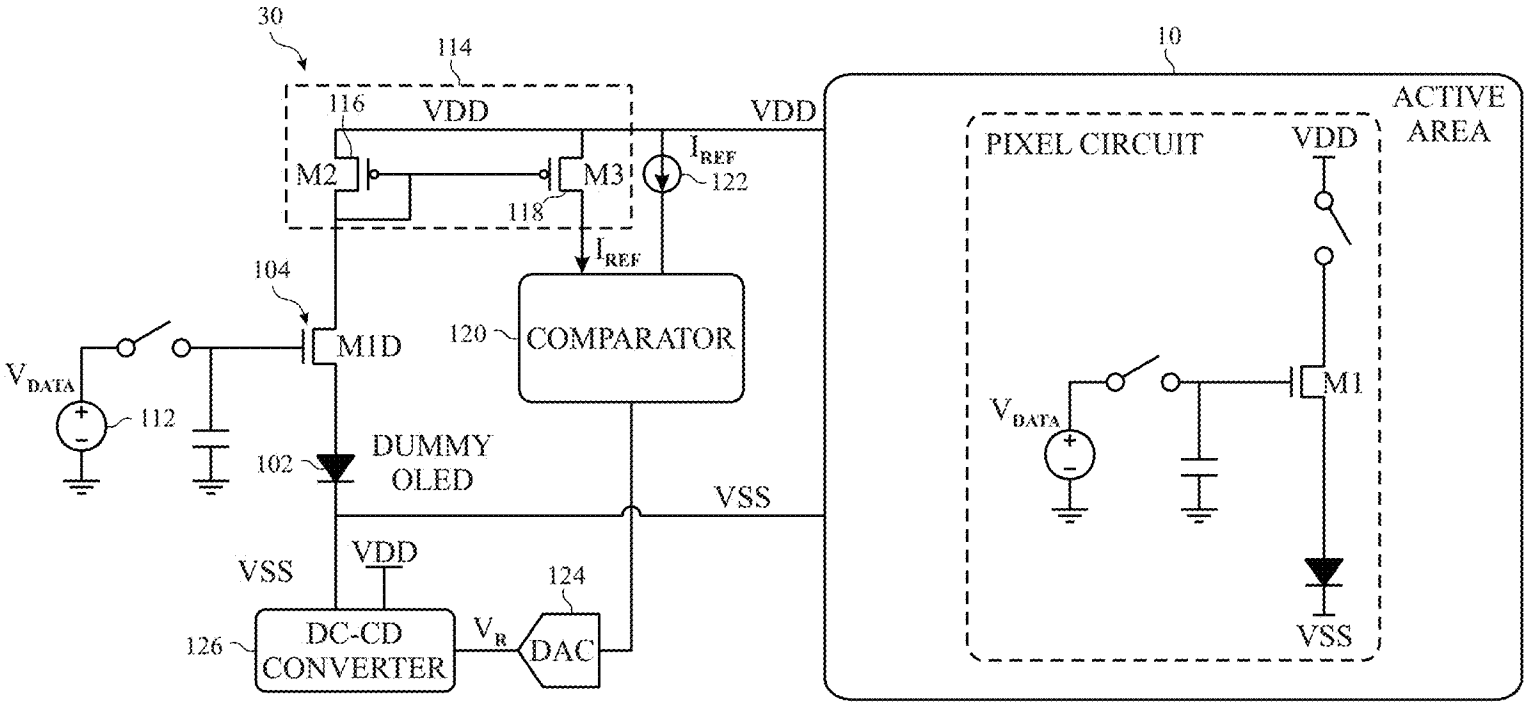
FIG. 9 is a circuit diagram of a replica pixel driving circuit for a pixel in the display of the electronic device of FIG. 1, in accordance with embodiments described herein.

FIG. 9 illustrates a schematic diagram of a replica pixel circuit 30 that may be used to compensate for bias voltage effects experienced by pixels 92 of the display 26. Although the replica pixel circuit 30 will be described with certain circuit components, it should be noted that other suitable circuit components may be used to perform similar operations as described below.

Referring now to FIG. 9, the replica pixel circuit 30 may include the LED 102 and the switch 104, as discussed above with respect to FIG. 8. In addition, the replica pixel circuit 30 may receive a voltage signal from a reference voltage source 112 (e.g., $V_{data}$) that may provide a certain voltage level (e.g., data voltage) that corresponds to a particular gray level for the LED 102. As discussed above, the switch 104 may output a current $I_{ds}$ to the LED 102 based on the data voltage.

In certain embodiments, the replica pixel circuit 30 may include a current mirror 114 that may reproduce the current $I_{ds}$ conducting via the switch 104. The current mirror 114 may include switches 116 and 118 arranged in a manner to output a replica current $I_{rep}$ via the switch 118. The replica current $I_{rep}$ mirrors the current $I_{ds}$.

As shown in FIG. 9, the replica current $I_{rep}$ may be input into a comparator component 120. In addition to the replica current $I_{rep}$, the comparator component 120 may receive a reference current $I_{ref}$. The reference current $I_{ref}$ may be provided by a current source 122, which may output the reference current $I_{ref}$ based on the reference voltage $V_{data}$. That is, the reference current $I_{ref}$ is determined based on an expected amount of current to be received by the LED 102 when the switch 104 is provided the reference voltage $V_{data}$. In this way, the comparator component 120 may compare the reference current $I_{ref}$ to the replica current $I_{rep}$, which matches the current provided to the LED 102. The comparator component 120 may be any suitable circuit component that compares two current waveforms or signals and determines a difference or error between the two.

The comparator component 120 may output an error or difference signal between the reference current $I_{ref}$ and the replica current $I_{rep}$. The difference signal may be a current or voltage signal that represents the difference between the reference current $I_{ref}$ and the replica current $I_{rep}$, and thus the difference between the reference current $I_{ref}$ and the current provided to the LED 102.

The difference signal may be provided to a digital-to-analog converter (DAC) component 124. The DAC component 124 may convert the difference signal into an analog signal (e.g., $V_r$), which may be provided to a voltage compensation component 126. The voltage compensation component 126 may receive the analog voltage signal $V_r$ and output a compensation voltage $V_c$ to an electrical node or wire that is coupled to the source voltage $V_{SS}$.

In one embodiment, the voltage compensation component 126 may be a DC-to-DC converter that may be coupled to the drain voltage $V_{DD}$. Based on the analog signal, the voltage compensation component 126 may increase or decrease the voltage of the voltage source $V_{SS}$. That is, if the replica current $I_{rep}$ is lower than the reference current $I_{ref}$, the analog signal may indicate to the voltage compensation component 126 that the source voltage $V_{SS}$ should decrease. In the same manner, if the replica current $I_{rep}$ is higher than the reference current $I_{ref}$, the analog signal may indicate to the voltage compensation component 126 that the source voltage $V_{SS}$ should increase. Although the voltage compensation component 126 is described as a DC-to-DC converter, it should be noted that the voltage compensation component 126 and the DAC component 124 may be replaced with other suitable circuit components (e.g., processor) that adjusts the voltage output of the source voltage $V_{SS}$ based on an error signal.

By increasing or decreasing the voltage source $V_{SS}$, the replica pixel circuit 30 may calibrate or adjust the current provided to the LED 102, such that the provided current matches an expected current to be provided to the LED 102 based on the fixed reference voltage $V_{data}$. Moreover, since the switch 104 and the LED 102 of the replica pixel circuit 30 substantially matches the switches and LEDs of the pixel circuits of the display 26, the bias voltage effects to the replica pixel circuit 30 may match the bias voltage effects to the pixel driving circuits of the display 26. As such, the adjustment to the voltage source $V_{SS}$ may be applied to each pixel driving circuit of the display 26 since the voltage source $V_{SS}$ may be a common voltage source coupled to each pixel driving circuit of the display 26. As a result, the LEDs of the display 26 may be compensated or calibrated for bias voltage effects that may occur due to certain ambient conditions, properties of the display 26, and the like.

To ensure that the replica pixel circuit 30 exhibits the same bias voltage effects as the pixel circuits of the display 26, the replica pixel circuit 30 may be disposed within a certain distance (e.g., less than a millimeter) from an active area of the display 26. The active area may include a region of the display 26 where the self-emissive pixels 92, the pixel driving circuitries for driving the pixels 92, and the like are positioned. As such, the replica pixel circuit 30 may be placed within a close proximity to the pixels 92, such that the replica pixel circuit 30 experiences the same ambient conditions of the pixels 92 or has similar display properties of the pixels 92.

Figure 10:
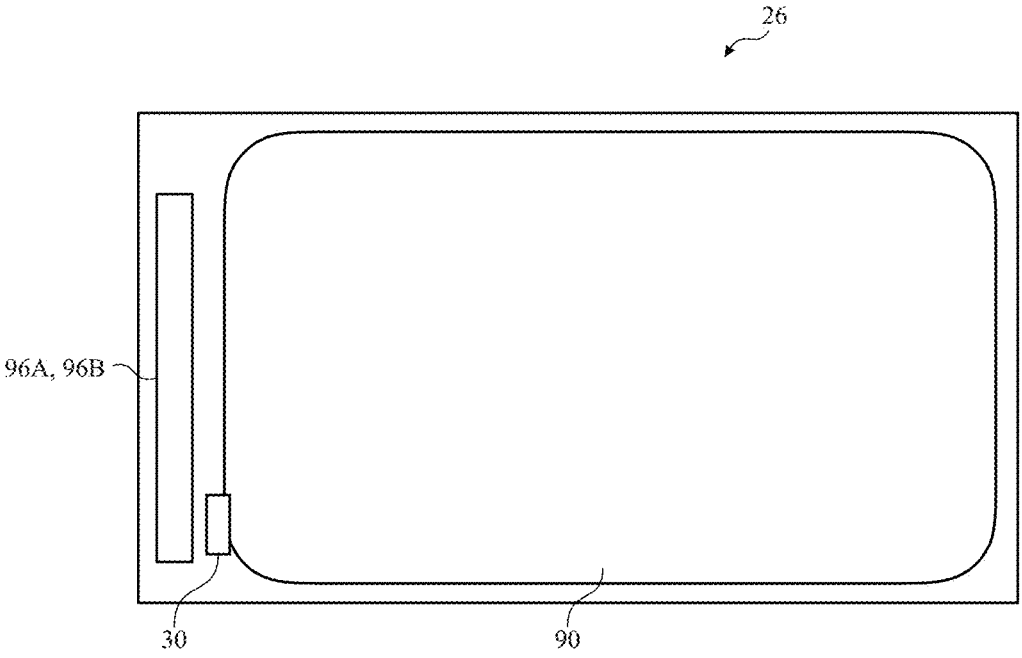
FIG. 10 is a block diagram illustrating an example location of a replica pixel driving circuit with respect to the display of the electronic device of FIG. 1, in accordance with embodiments described herein.

By way of example, FIG. 10 illustrates an example location of the replica pixel circuit 30 with respect to the self-emissive pixel array 90. As shown in FIG. 10, the replica pixel circuit 30 may be positioned adjacent to the power driver 96A or the image driver 96B and the self-emissive pixel array 90. It should be noted that although the replica pixel circuit 30 is illustrated as being disposed in a particular location with respect to the self-emissive pixel array 90, the replica pixel circuit 30 may be positioned in any suitable location that is adjacent to the self-emissive pixel array 90.

In some embodiments, multiple replica pixel circuits 30 may be disposed around the self-emissive pixel array 90, such that each respective replica pixel circuit 30 may control a source voltage $V_{SS}$ provided to a respective portion of the display 26. That is, for electronic devices having larger display sizes (e.g., laptop, desktop, tablet), additional replica pixel circuits 30 may be utilized to compensate for respective bias voltage effects experienced by different portions of the display 26 due to different respective ambient conditions or display properties.

Figure 11:
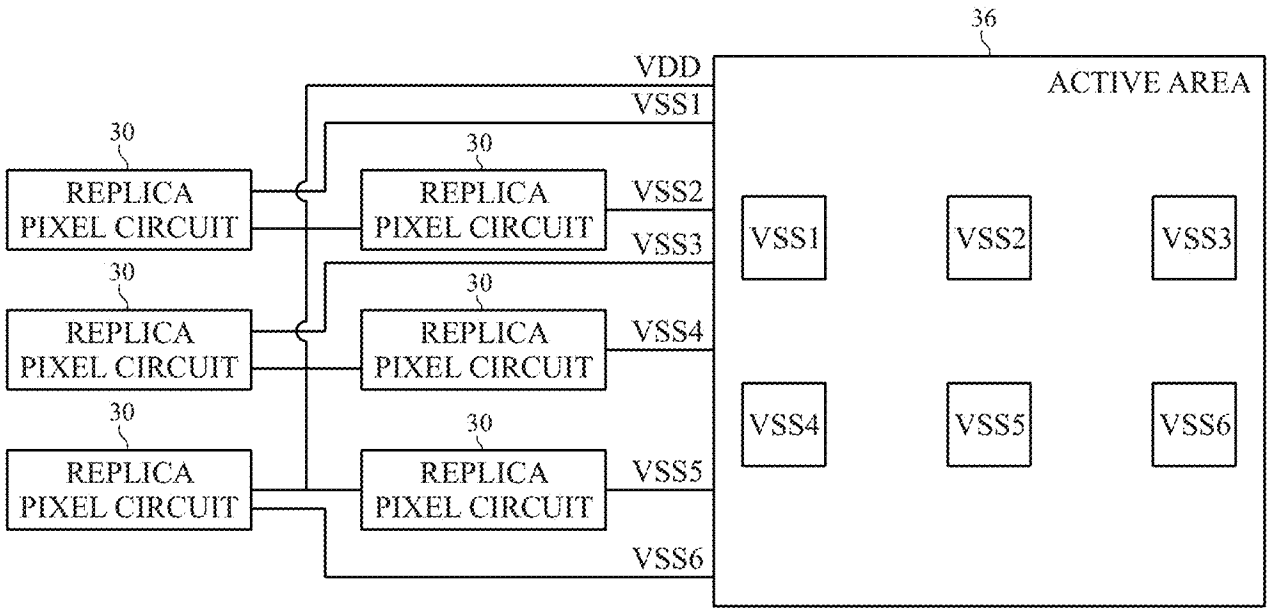
FIG. 11 is a block diagram of example replica pixel driving circuits for different portions of the display of the electronic device of FIG. 1, in accordance with embodiments described herein.
Figure 12:
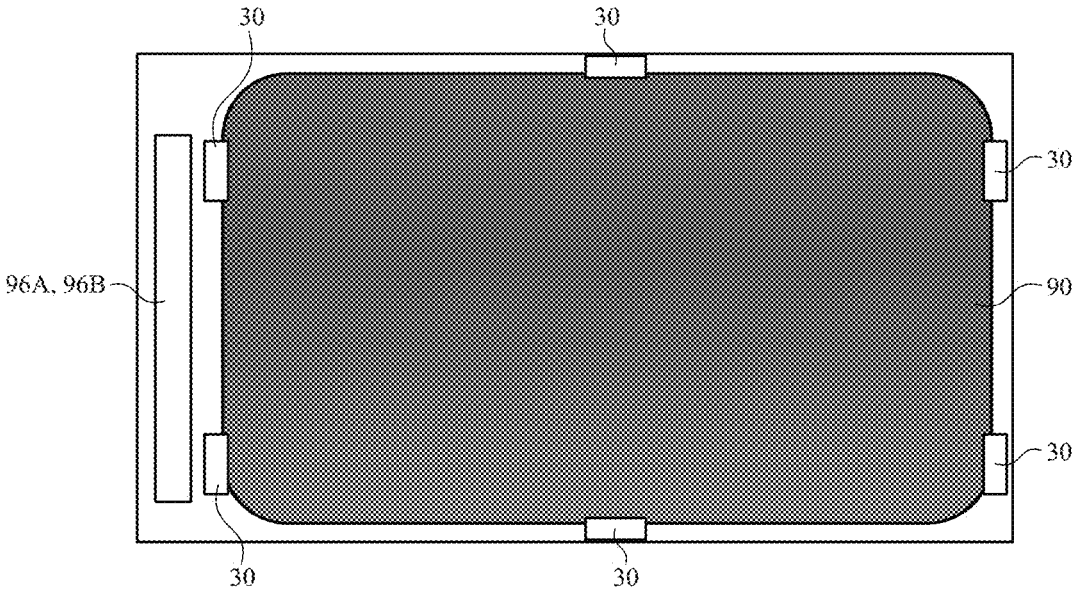
FIG. 12 is a block diagram illustrating example locations of the replica pixel driving circuits with respect to the display of the electronic device of FIG. 1, in accordance with embodiments described herein.

With this in mind, FIG. 11 illustrates a block diagram of six regions of the display 26 that operate using six respective source voltages $V_{SS1}$-$V_{SS6}$. The six respective source voltages $V_{SS1}$-$V_{SS6}$ may be coupled to six respective replica pixel circuits 30. In certain embodiments, each respective replica pixel circuit 30 may be positioned adjacent to a respective portion of the self-emissive pixel array 90. For instance, FIG. 12 illustrates an example embodiment in which six replica pixel circuits 30 are positioned around the self-emissive pixel array 90. Each respective replica pixel circuit 30 may adjust the respective voltage source $V_{SS}$, as described above, to compensate for the bias voltage effects experienced by each respective portion of the display 26 in light of the respective ambient conditions, the respective display properties, and the like. As a result, the entire display 26 may depict more uniform color and luminance provided the same input image data. Although FIG. 12 depicts a particular arrangement of replica pixel circuits 30 around the self-emissive pixel array 90, it should be noted that the replica pixel circuits 30 may be disposed in any suitable positions around the self-emissive pixel array 90 and is not limited to the arrangement depicted in FIG. 12.

Figure 13:
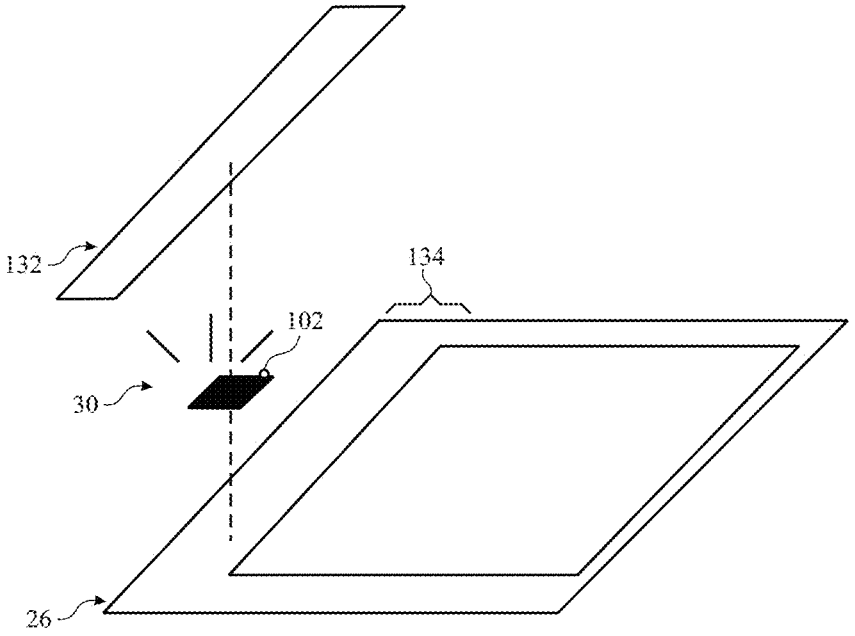
FIG. 13 is an exploded view of the display the electronic device of FIG. 1 illustrating a configuration of the replica pixel circuit within a bezel region of the electronic device, in accordance with embodiments described herein.

It should be noted that because the replica pixel circuit 30 described herein include the LED 102, the LED 102 will illuminate when current is provided to the LED 102. However, since the LED 102 is not intended to be viewed by a user of the electronic device 10, the electronic device 10 may include certain components to conceal the illumination of the LED 102 from view. For example, FIG. 13 illustrates an exploded view of the electronic device 10 that includes a mask 132 that may be disposed over the replica pixel circuit 30 to conceal the illumination of the LED 102. In one embodiment, the replica pixel circuit 30 may be disposed in a bezel region 134 of the display 26 and the mask 132 may be disposed over the bezel region 134. The mask 132 may be any suitable mask (e.g., black mask) that prevents light from being projected past the mask 132.

Figure 14:
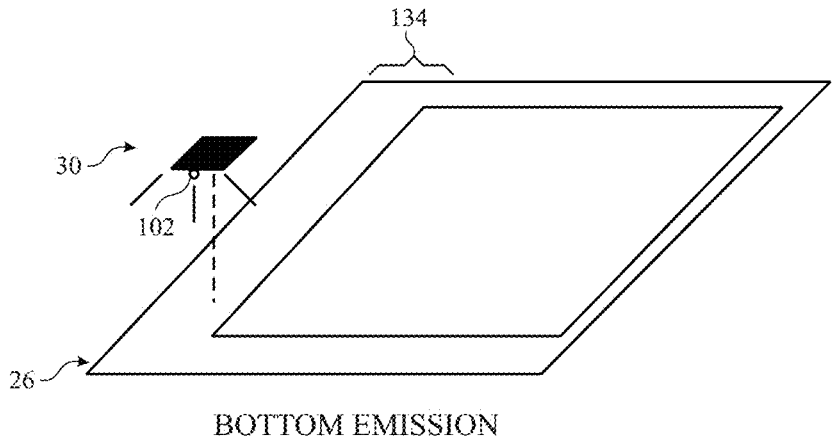
FIG. 14 is another exploded view of the display the electronic device of FIG. 1 illustrating a configuration of the replica pixel circuit within a bezel region of the electronic device, in accordance with embodiments described herein.

In another embodiment, the replica pixel circuit 30 may be disposed in such a manner that the LED 102 is oriented towards the circuitry of the electronic device 10 or in an opposite direction as compared to the pixels 92. That is, the LED 102 is positioned such that it cannot be viewed by a user of the electronic device 10. For example, FIG. 14 illustrates an exploded view of the electronic device 10 in which the replica pixel circuit 30 is disposed in the bezel region 134 of the display 26 and oriented such that the illumination of the LED 102 is not projected outwardly for view by the user of the electronic device 10. In this way, the mask 132 of FIG. 13 may be omitted from the design of the electronic device 10.

In some embodiments, temperature-sensing circuitry within the display 26 may be used to determine a temperature of pixels 92 of the display 26. The temperature-sensing circuitry may then provide the temperature data to a data driver (e.g., controller 94), which may adjust the data voltage provided to respective pixels 92 to compensate for expected bias voltage effects within the respective pixels 92. For instance, FIG. 15 illustrates a block diagram of a data adjustment circuit 140 that monitors one or more temperatures associated with one or more pixels 92 of the self-emissive pixel array 90 and adjusts data voltages provided to respective pixels based on respective detected temperatures.

Figure 15:
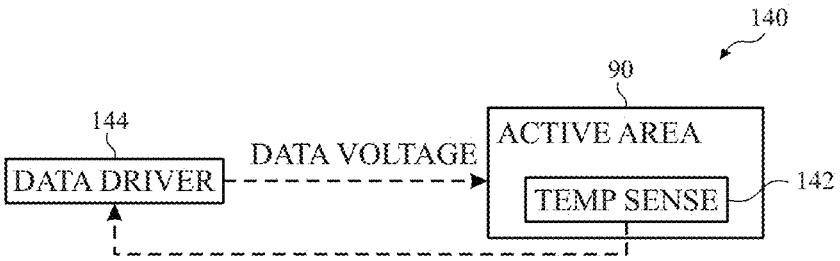
FIG. 15 is a block diagram illustrating a closed-loop data adjustment circuit for the display of the electronic device of FIG. 1, in accordance with embodiments described herein.

Referring to FIG. 15, the data adjustment circuit 140 may include temperature-sensing circuitry 142 and a data driver 144. The temperature-sensing circuitry 142 may include any suitable component that detects or measures a temperature. For example, the temperature-sensing circuitry 142 may include thermocouples or sensors that measure a temperature of a location in which the temperature-sensing circuitry 142 is located.

In another embodiment, the temperature-sensing circuitry 142 may include circuitry that senses or detects a voltage and/or current that is present on a TFT or other suitable switch 104 used to drive the LED 102. For example, the voltage associated with the switch 104 may correspond to a voltage stored on a capacitor coupled to the switch 104. Alternatively, the current associated with the switch 104 may be determined based on an amount of current conducting via the capacitor coupled to the switch 104. The temperature-sensing circuitry 142 or another suitable circuit may determine a temperature of the respective pixels 92 based on the voltage and/or current properties of the respective switches 104. For instance, the current conducting through the switch 104 may be representative of or directly related to the temperature of the respective pixel 92.

In any case, the temperature-sensing circuitry 142 may provide information (e.g., voltage, current, temperature) related to a temperature of a pixel 92 or a group of pixels 92 to the data driver 144. The data driver 144 (e.g., processor) may include logic or hardware components that determine expected bias voltage effects to the respective switches 104 associated with the respective pixels 92 based on the information. The data driver 144 may then adjust the data voltage provide to respective pixel driving circuits of the respective pixels 92 based on the expected bias voltage effects. That is, the data driver 144 may increase or decrease the data voltage provided to a respective pixel driving circuit to compensate for the bias voltage effects of the respective switch 104, thereby causing the LEDs of the respective pixels 92 to illuminate and depict a desired luminance and color value in accordance with the provided image data. The amount of voltage to increase or decrease may be available via a lookup table organized with respect to pixel temperatures and data voltages to account for hysteresis and other electrical properties.

Figure 16:
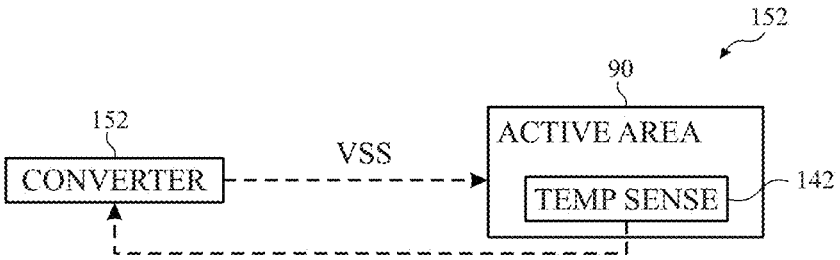
FIG. 16 is a block diagram illustrating a closed-loop voltage adjustment circuit for the display of the electronic device of FIG. 1, in accordance with embodiments described herein.

In certain embodiments, converter circuitry may be employed instead of the data driver 144 to adjust a source voltage ($V_{SS}$) provided to the respective pixels 92 based on the temperature sensed by the temperature sensing circuitry 142. For instance, FIG. 16 illustrates a block diagram of a voltage adjustment circuit 150 that may include the temperature-sensing circuitry 142 described above and a converter circuitry 152. In operation, the temperature-sensing circuitry 142 may provide information related to the temperature of one or more pixels 92 of the display 26 to the converter circuitry 152. The converter circuitry 152 may include a DC-to-DC converter circuit that may adjust the source voltage $VS_S$ provided to the respective pixels 92. In operation, the converter circuitry 152 may determine the expected bias voltage effects of the switches 104 associated with the respective pixels 92 based on the detected temperature of the respective pixels 92. The converter circuitry 152 may then adjust the source voltage $V_{SS}$ provided to the respective pixels 92 to compensate for the bias voltage effects.

It should be noted that the temperature-sensing circuitry 142 may be employed to detect the temperature or electrical properties of each pixel 92 or a group of pixels 92. That is, the temperature-sensing circuitry 142 may detect the temperature of a pixel in a collection of two, four, six, twenty, forty, sixty, or any other suitable number of pixels 92 that are adjacent to each other. Since the temperature properties of pixels 92 within a certain proximity of each other is likely to be similar, it may be useful to use one temperature-sensing circuitry 142 per certain number of pixels 92. Although the above-described embodiments are detailed as being performed with various types of circuitry, it should be noted that certain circuit components described herein may be implemented using a processor or other suitable processing device.

Although the foregoing discussion is related to monitoring the current provided to each pixel 92 and adjusting the current based on the ambient conditions or properties of the display 26, it should be noted that the presently disclosed techniques may also be performed on voltage driven pixel driving circuitry. That is, in some embodiments, an external circuit may be used to compare the voltage across the switch 104 or some other circuit component to a reference voltage expected to be present on the corresponding circuit component. Based on the difference between the reference voltage and the voltage detected across the respective circuit component, the compensation voltage $V_c$ provided to the electrical node or wire that is coupled to the source voltage $V_{SS}$ may be adjusted as discussed above.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A display device, comprising:

a display comprising a plurality of pixels; and a replica pixel circuit comprising:

a switching device that outputs a first current into a light emitting diode (LED) based on a received voltage;

the LED configured to illuminate to a first gray level based on the first current output by the switching device;

current mirror circuitry configured to generate a second current that mirrors the first current entering the LED;

a current source configured to output a reference current based on a voltage value that corresponds to the received voltage;

comparator circuitry that determines a difference between the second current and the reference current; and voltage adjustment circuitry that adjusts a source voltage output provided to the plurality of pixels based on the difference.

2. The display device of claim 1, wherein the replica pixel circuit is disposed in a bezel region of the display device.

3. The display device of claim 1, wherein the replica pixel circuit is disposed adjacent to the plurality of pixels.

4. The display device of claim 1, wherein the source voltage output is coupled to the LED.

5. The display device of claim 1, comprising a mask configured to block the LED.

6. The display device of claim 1, wherein the reference current corresponds to an expected amount of current received by the LED when the switching device receives the voltage having the voltage value.

7. The display device of claim 1, wherein the LED is oriented in an opposite direction as compared to the plurality of pixels.

8. A circuit, comprising:

a display comprising a plurality of pixels; and a replica pixel circuit comprising:

a switching device that outputs a first current into a light emitting diode (LED) based on a received voltage;

the LED configured to illuminate to a first gray level based on the first current output by the switching device;

current mirror circuitry configured to generate a second current that mirrors the first current entering the LED;

a current source configured to output a reference current based on a voltage value that corresponds to the received voltage;

comparator circuitry that determines a difference between the second current and the reference current; and voltage adjustment circuitry that adjusts a source voltage output provided to the plurality of pixels based on the difference.

9. The circuit of claim 8, wherein the voltage adjustment circuitry comprises a DC-to-DC converter configured to adjust the source voltage output based on a reference voltage that corresponds to the difference.

10. The circuit of claim 8, wherein the voltage adjustment circuitry is coupled to a drain voltage, and wherein the drain voltage is coupled to the current mirror circuitry.

11. The circuit of claim 8, wherein the switching device comprises a driving transistor.

12. The circuit of claim 8, comprising a voltage source configured to output the voltage to a gate of the switching device.

13. The circuit of claim 8, comprising a digital-to-analog circuit configured to receive a signal from the comparator circuitry, wherein the signal is generated based on the difference.

14. The circuit of claim 8, wherein LED is oriented in an opposite direction as compared to the at least one pixel of the electronic display.

* * * * *